US011162486B2

(12) United States Patent
Powers et al.

(10) Patent No.: US 11,162,486 B2
(45) Date of Patent: Nov. 2, 2021

(54) FLUID PUMP PROVIDING BALANCED INPUT/OUTPUT FLOW RATE

(71) Applicant: Ivenix, Inc., Amesbury, MA (US)

(72) Inventors: Benjamin G. Powers, Portsmouth, NH (US); Jesse E. Ambrosina, Topsfield, MA (US); Michael J. Scarsella, Boylston, MA (US)

(73) Assignee: Ivenix, Inc., North Andover, MA (US)

( * ) Notice: Subject to any disclaimer, the term of this patent is extended or adjusted under 35 U.S.C. 154(b) by 279 days.

(21) Appl. No.: 15/824,138

(22) Filed: Nov. 28, 2017

(65) Prior Publication Data

US 2019/0162178 A1 May 30, 2019

(51) Int. Cl.

| | |
|---|---|
| ***F04B 43/12*** | (2006.01) |
| ***F04B 43/00*** | (2006.01) |
| ***F04B 49/20*** | (2006.01) |
| ***F04B 43/02*** | (2006.01) |
| ***F04B 49/06*** | (2006.01) |
| ***F04B 43/08*** | (2006.01) |
| ***F04B 43/14*** | (2006.01) |

(52) U.S. Cl.

CPC ..... *F04B 43/1223* (2013.01); *F04B 43/02* (2013.01); *F04B 43/082* (2013.01); *F04B 43/14* (2013.01); *F04B 49/06* (2013.01); *F04B 49/20* (2013.01); *F04B 43/0072* (2013.01); *F04B 2205/09* (2013.01)

(58) Field of Classification Search

CPC ..... F04B 43/082; F04B 43/095; F04B 43/12
See application file for complete search history.

(56) References Cited

U.S. PATENT DOCUMENTS

| | | | | |
|---|---|---|---|---|
| 4,561,830 | A | 12/1985 | Bradley | |
| 5,165,873 | A * | 11/1992 | Meijer | A61M 5/14228 417/474 |
| 5,165,874 | A | 11/1992 | Sancoff et al. | |
| 5,217,355 | A | 6/1993 | Hyman et al. | |
| 5,798,600 | A * | 8/1998 | Sager | F04B 17/003 310/328 |
| 5,980,490 | A | 11/1999 | Tsoukalis | |
| 6,064,797 | A * | 5/2000 | Crittendon | F04B 43/082 388/800 |
| 6,234,773 | B1 * | 5/2001 | Hill | A61M 5/14228 417/474 |
| 6,558,347 | B1 * | 5/2003 | Jhuboo | A61M 5/14228 604/151 |

(Continued)

*Primary Examiner* — Dominick L Plakkoottam
(74) *Attorney, Agent, or Firm* — Armis IP Law, LLC

(57) ABSTRACT

A fluid pump device includes an elastically deformable conduit, multiple volume displacement elements, and a controller. During operation, the controller controls movement of the multiple volume displacement elements (such as compensation volume displacement elements and occluding volume displacement elements) with respect to the elastically deformable conduit at different times to cause flow of fluid in the elastically deformable conduit downstream to a recipient. The controller controls movement of the multiple volume displacement elements to volumetrically balance: i) an input flow rate of input fluid conveyed from a fluid source downstream to an input of the elastically deformable conduit, and ii) an output flow rate of output fluid delivered from an output of the elastically deformable conduit downstream to a recipient.

33 Claims, 16 Drawing Sheets

(56) References Cited

U.S. PATENT DOCUMENTS

| | | | | |
|---|---|---|---|---|
| 6,881,043 | B2 | 4/2005 | Barak | |
| 7,695,255 | B2 | 4/2010 | Ben-Shalom et al. | |
| 8,029,253 | B2 | 10/2011 | Rotem et al. | |
| 8,133,035 | B2 | 3/2012 | Wolff | |
| 8,535,025 | B2 | 9/2013 | Rotem et al. | |
| 8,894,391 | B2 | 11/2014 | Wolff | |
| 8,920,144 | B2 * | 12/2014 | Rotem | F04B 49/06 417/477.7 |
| 9,687,605 | B2 | 6/2017 | Yagi et al. | |
| 10,113,543 | B2 * | 10/2018 | Rotem | F04B 43/12 |
| 2007/0194045 | A1 * | 8/2007 | Py | B65B 39/004 222/105 |
| 2008/0304982 | A1 * | 12/2008 | Miyazaki | F04B 19/006 417/412 |
| 2014/0356193 | A1 * | 12/2014 | Nzike | F04B 43/082 417/53 |
| 2015/0088094 | A1 * | 3/2015 | Gray | A61M 5/142 604/507 |
| 2015/0374903 | A1 | 12/2015 | Muto et al. | |
| 2017/0211959 | A1 * | 7/2017 | Adler | F04B 43/095 |

* cited by examiner

FLUID PUMP PROVIDING BALANCED INPUT/OUTPUT FLOW RATE

BACKGROUND

FIGS. 1-6 illustrate operation of delivering fluid using a conventional peristaltic fluid pump.

More specifically, the peristaltic fluid pump 100 in FIG. 1 includes selectively movable flow-occluding elements F1 (finger #1), F2 (finger #2), and F3 (finger #3) to deliver fluid from fluid source 120 to a recipient 108. In general, as further discussed below, each finger is used as an occluding volume displacement element at different times to cause fluid to flow at a non-linear rate to the recipient 108.

As shown in FIG. 1, at time T1 of a first control cycle, controller 140 moves finger #1 (F1) to occlude the elastic tube 121 (such as a flexible tube) at location P1. Occlusion of the tube 121 using finger #1 prevents a flow of fluid with respect to location P1.

Between time T1 and time T2 of the first control cycle as shown in FIG. 2, the controller 140 moves finger #2 (F2) to occlude the elastically deformable tube 121 at location P2. In this example, downward movement of the finger #2 causes a displacement of 5 units of the output fluid 152 to be pushed downstream (with respect to occluding finger #1) through the elastically deformable tube 121 towards the recipient 108.

Between time T2 and time T3 of the first control cycle as shown in FIG. 3, the controller 140 controllably moves finger #1 (F1) and finger #3 (F3). More specifically, upward movement of the finger #1 causes a flow of 5 units of fluid to be delivered from fluid source 120 into the elastically deformable tube 121 upstream of location P2. Downward movement of the finger #3 causes 5 units of the fluid to be delivered downstream (with respect to occluding finger #2) in elastic tube 121 towards the recipient 108.

Between time T3 and time T4 of the first control cycle as shown in FIG. 4, the controller 140 controllably moves finger #2 in an upward direction to cause another 5 units of fluid to flow from the fluid source 120 into a portion of the elastically deformable tube 121 upstream with respect to occluding finger #3 (location P3).

Between time T4 and time T5 of the first control cycle as shown in FIG. 5, the controller 140 controllably moves finger #1 in a downward position at P1. This movement of finger F1 occludes (stops) a flow of fluid through the elastically deformable tube 121 at position #1 (P1) as well as causes a displacement of 5 units of fluid to be conveyed in an upstream direction to the fluid source 120 with respect to occluding finger #3 (location P3).

Between time T5 and time T6 of the first control cycle shown in FIG. 6, to complete the first cycle, the controller 140 controllably moves finger #3 in an upward position. This causes 5 units of fluid to be conveyed from the recipient 108 upstream into the elastically deformable tube 121. Operation at time T6 completes a first delivery cycle. At the conclusion of this cycle, a total of 5 units of fluid have been conveyed from the source to the recipient.

BRIEF DESCRIPTION OF EMBODIMENTS

This disclosure includes the observation that the above example of controlling the multiple fingers (volume displacement elements) of the respective conventional peristaltic pump as shown in FIGS. 1-6 results in undesirable (nonlinear, as well as forward and reverse) flow of fluid. This erratic, non-linear and bi-directional flow of fluid as discussed above occurs no matter how many fingers are present in the peristaltic fluid pump.

This disclosure further includes the observation that the flow variations within the cycle also causes a discrepancy (phase delay) between the flow into and out of the respective conventional peristaltic pump. This phase delay precludes the ability to measure and adjust flow rate of the pump output based on a flow rate measurement of the flow into the pump. Accordingly, the conventional peristaltic fluid pump is not desirable for use in certain applications such as those requiring more steady flow of fluid to a recipient.

Accordingly, embodiments herein include novel approaches to controlling delivery of fluid to a recipient.

More specifically, in one embodiment, a fluid pump device includes an elastically deformable conduit, multiple volume displacement elements, and a controller. During operation, the controller controllably contacts the volume displacement elements to the elastically deformable conduit at different times to cause fluid in the elastically deformable conduit to flow to a recipient. In one embodiment, the controller controls movement of the multiple volume displacement elements in a specific manner to volumetrically balance: i) an input flow rate of input fluid conveyed from a fluid source downstream to an input of the elastically deformable conduit, and ii) an output flow rate of output fluid delivered from an output of the elastically deformable conduit downstream to a recipient.

In one embodiment, the controller is operable to control the movement of the volume displacement elements to substantially equalize the output flow rate of the elastically deformable conduit to the input flow rate. If desired, the controller controls movement of volume displacement elements within a control cycle such that the output fluid flow matches the input fluid flow during each portion of a respective control cycle.

In accordance with further embodiments, the controller controls the multiple volume displacement elements such that the input flow rate and the output flow rate are substantially constant. The balanced (constant) flow of fluid as discussed herein ensures that the recipient receives fluid from a fluid source at a constant flow rate, which contrasts the erratic (pulsatile) fluid flow for conventional peristaltic fluid pumps as discussed above in the background section.

In accordance with further embodiments, both the input flow rate and the output flow rate are substantially constant and equal. In such an instance, the recipient receives the output fluid at a substantially constant rate within each cycle as well as over multiple cycles of controlling movement of the multiple volume displacement elements. Further embodiments herein include controlling movement of the first volume displacement elements and the second volume displacement elements to provide constant uni-directional flow (same direction flow) of the output fluid to the recipient.

In accordance with certain embodiments, the controlled movement of the multiple volume displacement elements by the controller (and/or other resource) prevents a backflow of the input fluid received at the input of the elastically deformable fluid toward the fluid source. In other words, in one embodiment, the fluid pump as discussed herein provides one way, continuous linear volumetric flow of fluid to a recipient. Thus, when fluid is outputted from the fluid source into the elastically deformable conduit, the pump operation by the volume displacement elements does not cause previously outputted fluid from the fluid source to backflow back into the fluid source as would occur in the conventional peristaltic fluid pumps as indicated above in the background section.

These and other more specific embodiments are disclosed in more detail below.

Note that any of the resources as discussed herein can include one or more computerized devices, fluid delivery device, medical devices, infusion pumps, fluid delivery systems, or the like to carry out and/or support any or all of the method operations disclosed herein. In other words, one or more computerized devices or processors can be programmed and/or configured to operate as explained herein to carry out different embodiments of the invention.

Yet other embodiments herein include software programs to perform the steps and operations summarized above and disclosed in detail below. One such embodiment comprises a computer program product including a non-transitory computer-readable storage medium (such as a physical computer readable hardware storage medium) on which software instructions are encoded for subsequent execution. The instructions, when executed in a computerized device (e.g., computer processing hardware) having a processor, program and/or cause the processor to perform the operations disclosed herein. Such arrangements are typically provided as software, code, instructions, and/or other data (e.g., data structures) arranged or encoded on a non-transitory computer readable storage medium such as an optical medium (e.g., CD-ROM), floppy disk, hard disk, memory stick, etc., or other a medium such as firmware in one or more ROM, RAM, PROM, etc., or as an Application Specific Integrated Circuit (ASIC), etc. The software or firmware or other such configurations can be installed onto a computerized device to cause the computerized device to perform the techniques explained herein.

Accordingly, embodiments herein are directed to a method, system, computer program product, etc., that supports operations as discussed herein.

One embodiment herein includes a computer readable storage medium and/or system having instructions stored thereon. The instructions, when executed by computer processor hardware, cause the computer processor hardware to: control first volume displacement elements to occlude an elastically deformable conduit at different places along its length during a fluid delivery cycle; and during the fluid delivery cycle, controlling second volume displacement elements (compensation displacement elements) to volumetrically balance: i) an input flow rate of input fluid conveyed from a fluid source downstream to an input of the elastically deformable conduit, and ii) an output flow rate of output fluid delivered from an output of the elastically deformable conduit downstream to a recipient.

The ordering of the operations above has been added for clarity sake. Note that any of the processing steps as discussed herein can be performed in any suitable order.

Other embodiments of the present disclosure include software programs and/or respective hardware to perform any of the method embodiment steps and operations summarized above and disclosed in detail below.

It is to be understood that the system, method, apparatus, instructions on computer readable storage media, etc., as discussed herein also can be embodied strictly as a software program, firmware, as a hybrid of software, hardware and/or firmware, or as hardware alone such as within a processor, or within an operating system or within a software application.

As discussed herein, techniques herein are well suited for managing distribution of fluid to a downstream recipient. However, it should be noted that embodiments herein are not limited to use in such applications and that the techniques discussed herein are well suited for other applications as well.

Additionally, note that although each of the different features, techniques, configurations, etc., herein may be discussed in different places of this disclosure, it is intended, where suitable, that each of the concepts can optionally be executed independently of each other or in combination with each other. Accordingly, the one or more present inventions as described herein can be embodied and viewed in many different ways.

Also, note that this preliminary discussion of embodiments herein purposefully does not specify every embodiment and/or incrementally novel aspect of the present disclosure or claimed invention(s). Instead, this brief description only presents general embodiments and corresponding points of novelty. For additional details and/or possible perspectives (permutations) of the invention(s), the reader is directed to the Detailed Description section and corresponding figures of the present disclosure as further discussed below.

Figure 1:
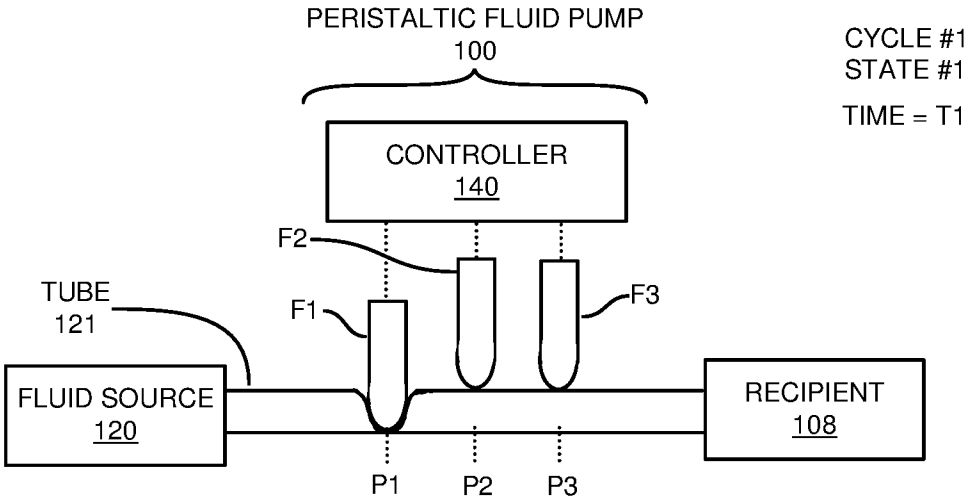
FIG. 1 is an example diagram illustrating a first state of operating a conventional peristaltic fluid pump.
Figure 2:
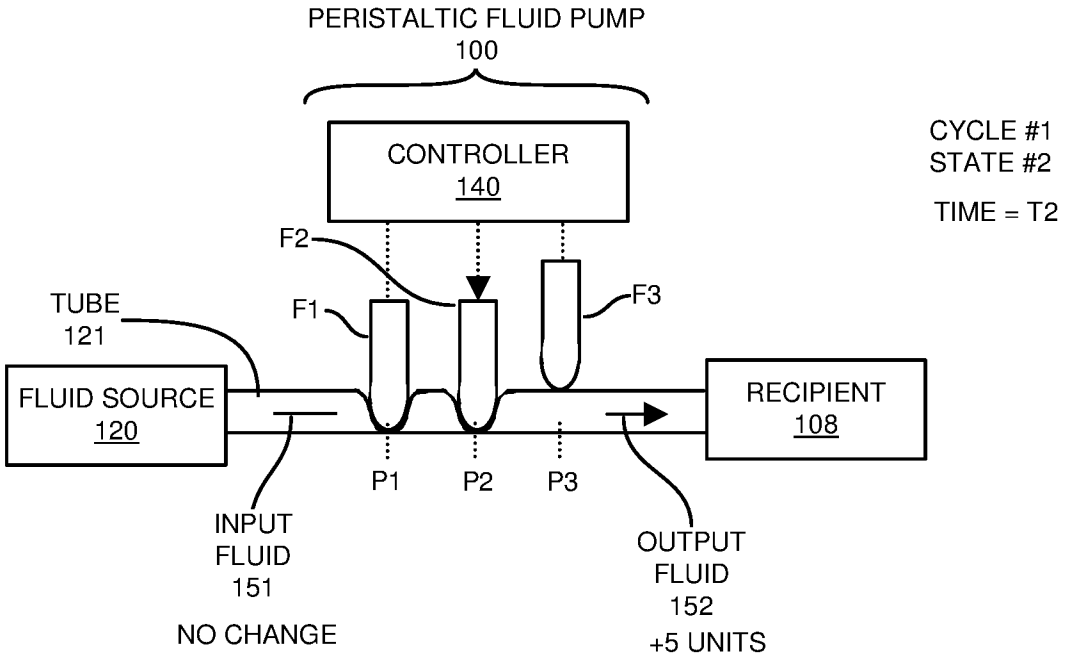
FIG. 2 is an example diagram illustrating a second state of operating a conventional peristaltic fluid pump.
Figure 3:
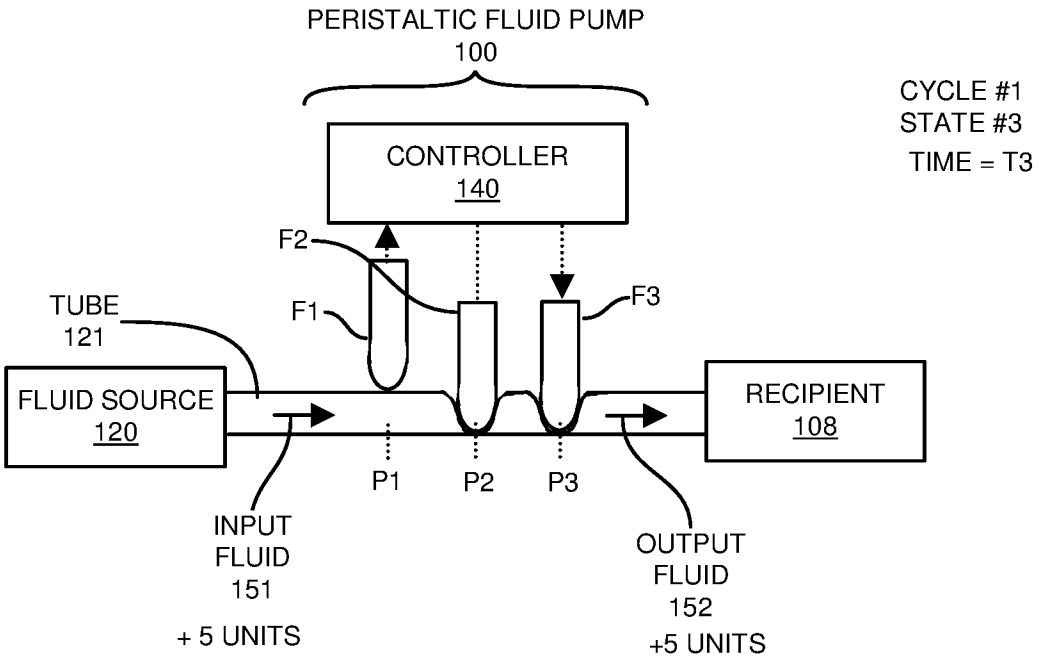
FIG. 3 is an example diagram illustrating a third state of operating a conventional peristaltic fluid pump.
Figure 4:
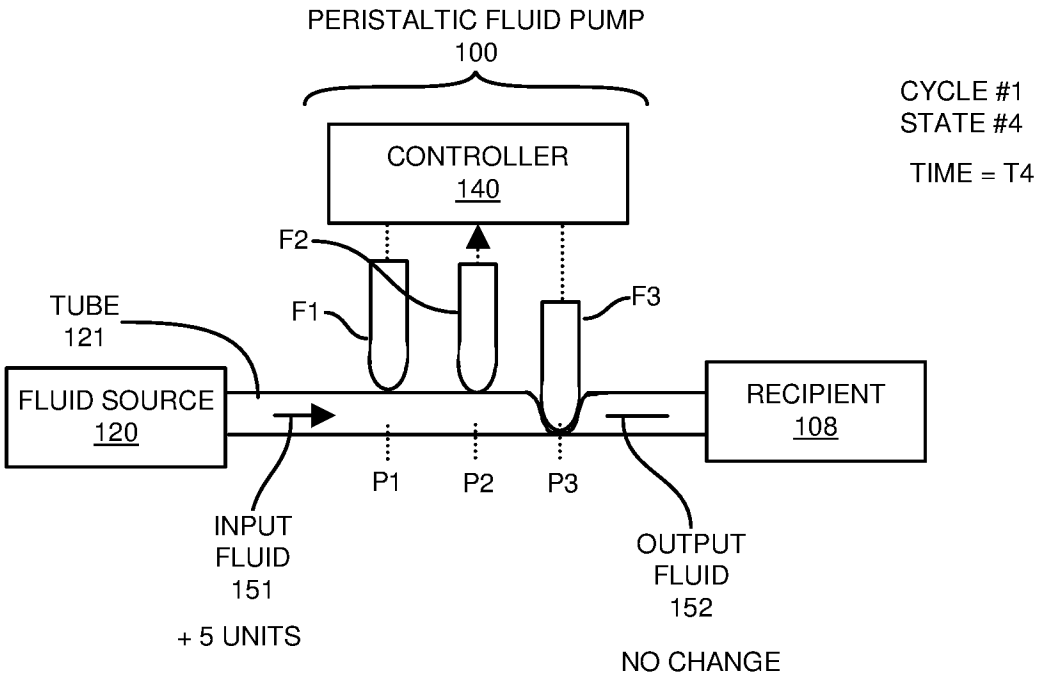
FIG. 4 is an example diagram illustrating a fourth state of operating a conventional peristaltic fluid pump.
Figure 5:
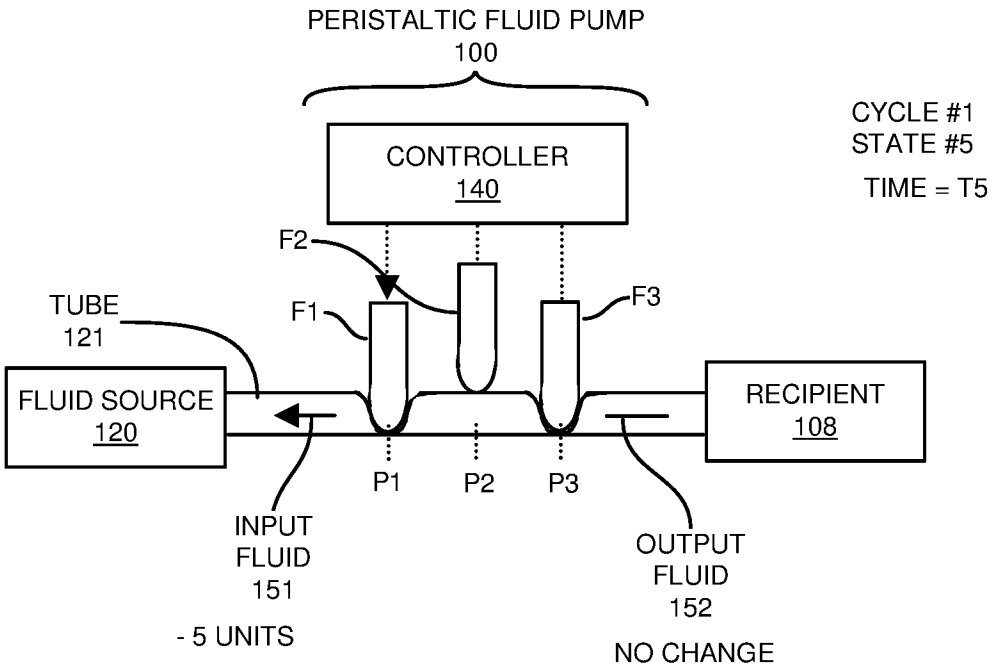
FIG. 5 is an example diagram illustrating a fifth state of operating a conventional peristaltic fluid pump.
Figure 6:
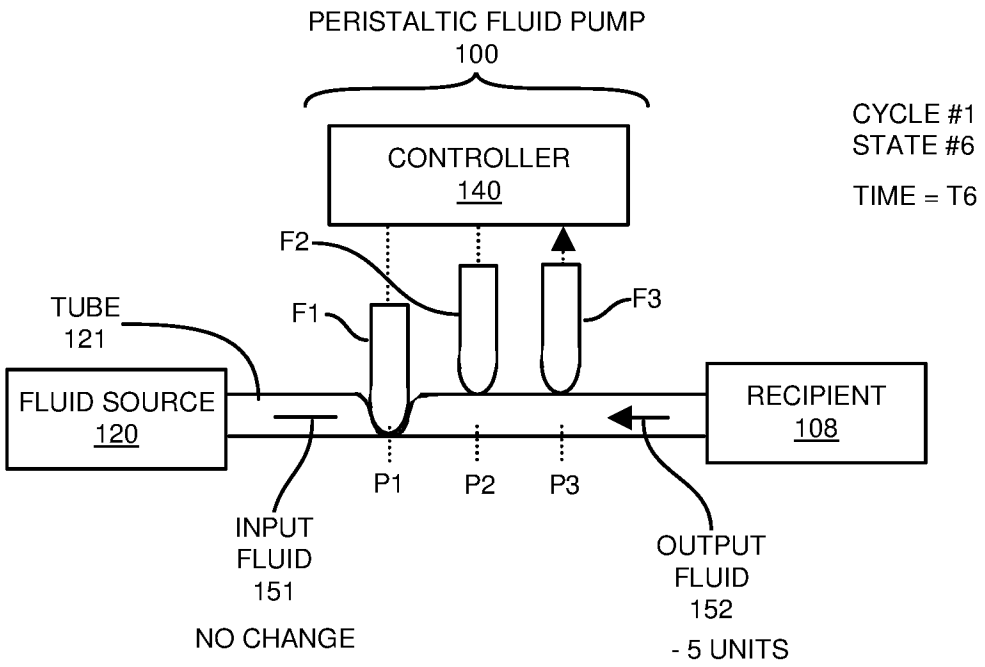
FIG. 6 is an example diagram illustrating a sixth state of operating a conventional peristaltic fluid pump.

The foregoing and other objects, features, and advantages of the invention will be apparent from the following more particular description of preferred embodiments herein, as illustrated in the accompanying drawings in which like reference characters refer to the same parts throughout the different views. The drawings are not necessarily to scale, with emphasis instead being placed upon illustrating the embodiments, principles, concepts, etc.

DETAILED DESCRIPTION AND FURTHER SUMMARY OF EMBODIMENTS

Now, more specifically, the following FIGS. 7 and 9-13 illustrate unique operations to control a flow of fluid from a fluid source to a respective recipient according to embodiments herein. FIG. 8 is a timing diagram illustrating an example cycle of controlling multiple volume displacement elements to achieve balanced fluid flow according to embodiments herein. FIG. 14 is an example diagram illustrating flow control over multiple cycles.

Figure 7:
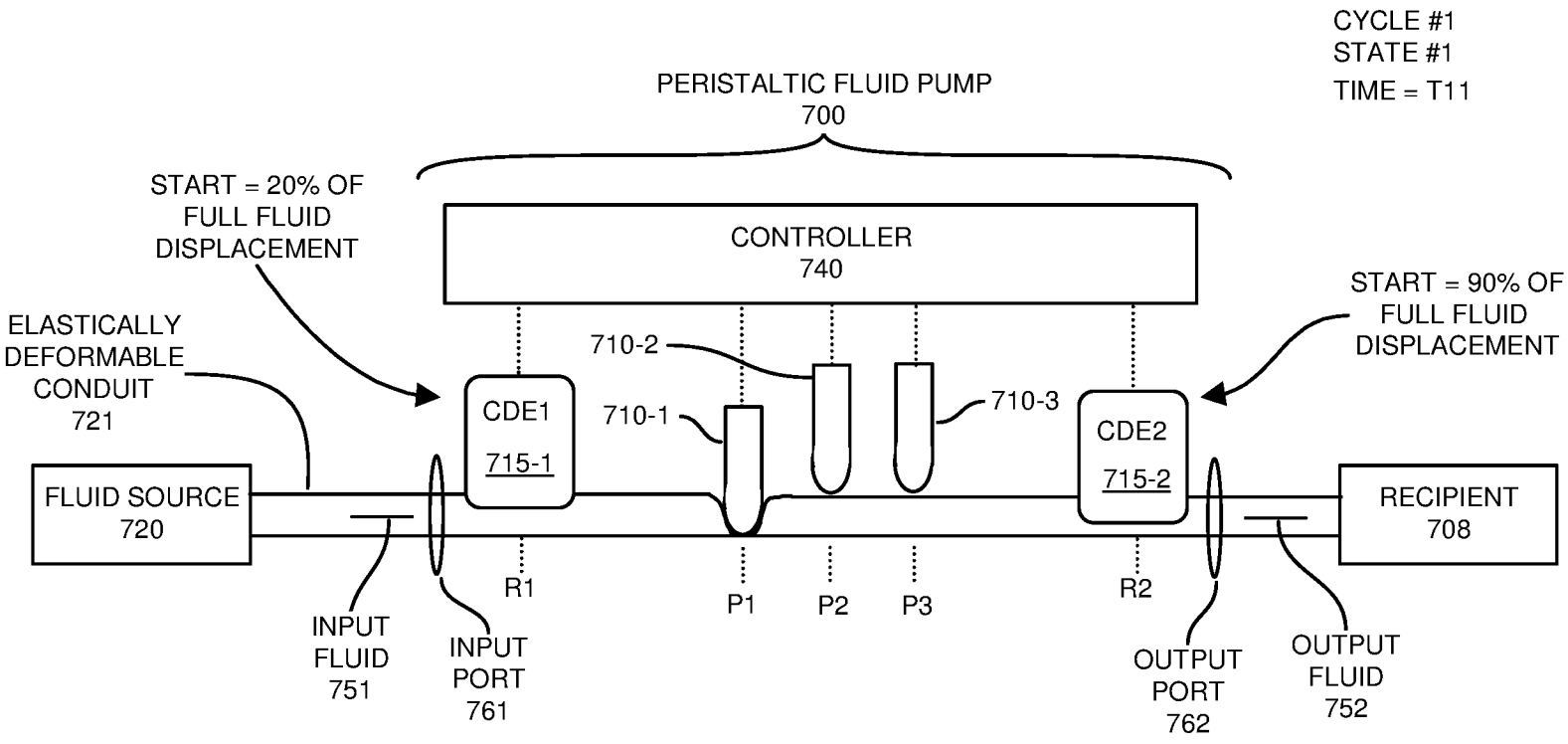
FIG. 7 is an example diagram illustrating a first state of operating a fluid pump according to embodiments herein.
Figure 8:
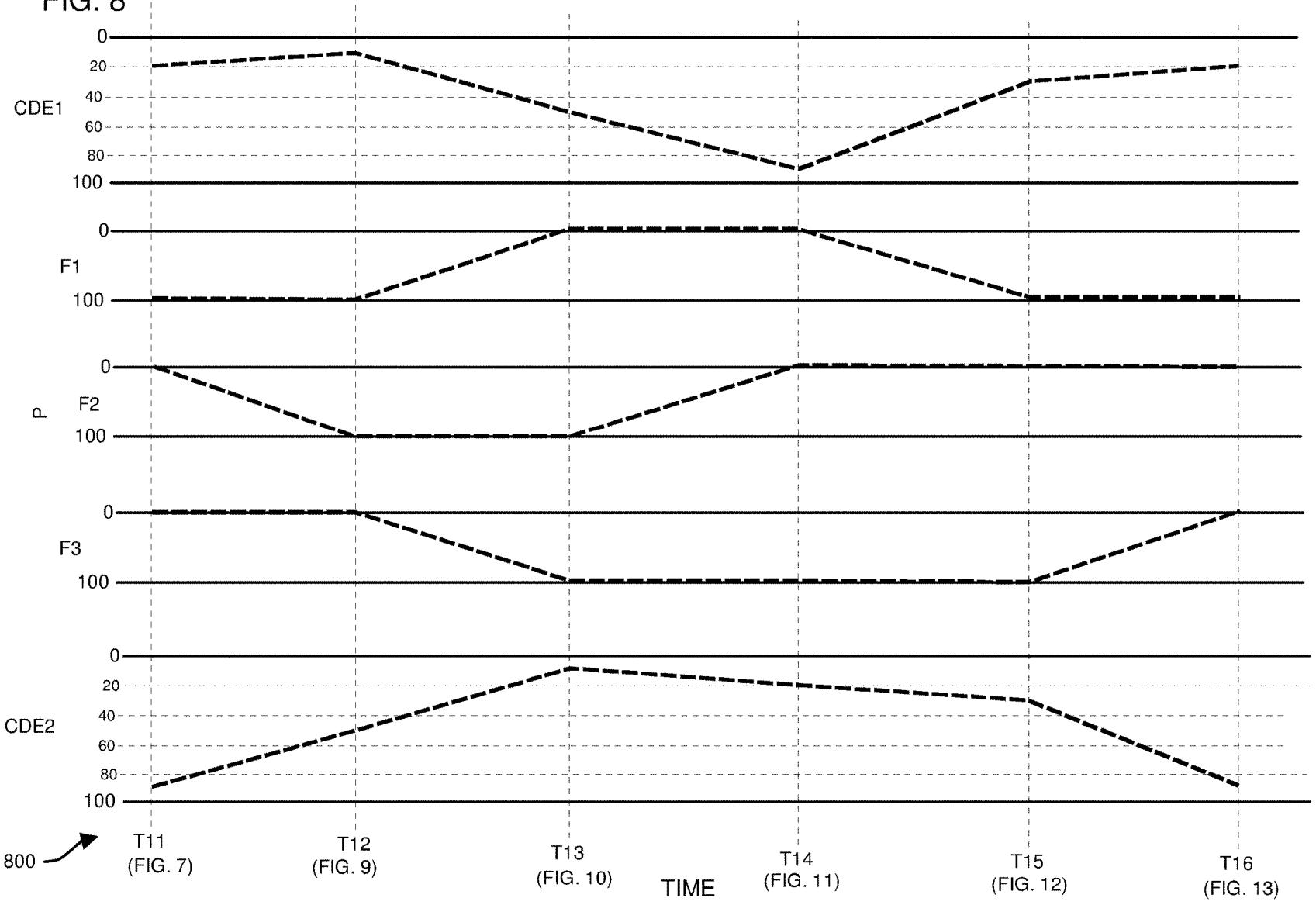
FIG. 8 is an example diagram illustrating a timing diagram of controlling volume displacement elements of a fluid pump according to embodiments herein.

Referring more particularly to FIG. 7, in accordance with further embodiments, the elastically deformable conduit 721 is a flexible tube with memory. For example, the elastically deformable conduit 721 retains its original shape after being deformed. As an alternative to being a tube, the elastically deformable conduit 721 is a rigid plastic cassette with a silicone diaphragm cover. The diaphragm would be deformed by the displacement elements and pushed against the plastic housing to occlude flow, then would rebound upon release.

Further in this example embodiment, the fluid pump 700 (such as a peristaltic fluid pump) includes a compensation volume displacement element 715-1 (CDE1 such as a first idler) and a compensation volume displacement element 715-2 (CDE2 such as a second idler).

In one embodiment, the compensation volume displacement elements 715 are non-occluding displacement elements in contact with the elastically deformable conduit 721 to balance a flow of fluid on both sides of an occluded location of elastically deformable conduit 721. However, if desired, the compensation volume displacement elements 715 can be used to occlude fluid flow through the conduit 721.

As a more specific example, the controller 740 controls movement of the fingers (volume displacement elements 710) of peristaltic fluid pump 700 at different times to occlude and displace a flow of fluid through the elastically deformable conduit 721 to deliver fluid to a respective recipient 108. In addition to controlling movement volume displacement elements 710, note that the controller 740 controls displacement settings of the compensation volume displacement elements 715 (at respective position R1 and R2) to balance a flow of fluid with respect to a portion of the elastically deformable conduit 721 that is occluded by one of multiple volume displacement elements 710.

In one embodiment, each compensation volume displacement element 715 is substantially wider than a respective one of volume displacement elements 710. In one embodiment, each of the compensation volume displacement elements 715 displaces 2 times more fluid than a respective one of volume displacement elements 710.

Note further that, in one embodiment as previously discussed, the elastically deformable conduit 721 is a flexible tube with memory. The elastically deformable conduit 721 retains its original shape after being deformed. Controller 740 includes one or more mechanical devices (such as a cam shaft, electro-mechanical linear position servo, motor, etc.) to control displacement of displacement elements 710 and 715.

In this example embodiment, at time T11 of a control cycle as shown in FIG. 7, the controller 740 moves volume displacement element 710-1 to occlude the elastically deformable conduit 721 (such as a flexible tube) at location P1.

FIG. 8 is an example diagram illustrating the movement of volume displacement elements over time to provide balanced input/output fluid flow according to embodiments herein.

As shown, time T11 of timing diagram 800 indicates the starting position of each of the volume displacement elements 710 (F1, F2, and F3) and 715 (CDE1 and CDE2) according to embodiments herein.

At time T11, the compensation volume displacement element 715-1 (CDE1) is positioned to provide 20% of full closed fluid displacement at location R1; the compensation volume displacement element 715-2 is positioned to provide 90% of full closed fluid displacement at location R2; the volume displacement element 710-1 (finger F1) is positioned to provide 100% closure (full close) at location P1 of the elastically deformable conduit 721; the volume displacement element 710-2 (F2) is positioned to provide 0% closure (full open) at location P2 of the elastically deformable conduit 721; and the volume displacement element 710-3 (F3) is positioned to provide 0% closure (full open) at location P3 of the elastically deformable conduit 721.

In one embodiment, the compensation volume displacement elements 715-1 and 715-2 are not used to occlude flow of fluid through the conduit 721. Instead, as discussed herein, the compensation volume displacement elements 715-1 and 715-2 are used to provide compensation and continuous linear flow of fluid within a given control cycle. Additionally, as further described herein, the volume displacement elements 710-1, 710-2, and 710-3 provide occlusion (blockage of fluid flow) at different points along conduit 721 at different times to facilitate downstream flow of fluid as further described herein.

As further shown, subsequent to time T11, the timing diagram 800 illustrates control of the volume displacement elements 710 and 715 over time to provide volumetrically linear flow or displacement of fluid to a recipient 708.

Assume in the following example that each of the volume displacement elements 710 displaces 5 units of fluid between full open and full closed positions.

Assume further in the following example that each of the (compensation) volume displacement elements 715 displaces 10 units of fluid between full open and full closed positions.

Thus, 10% movement of a respective compensation volume displacement element 715 results in a displacement of 1 unit volume of fluid in the elastically deformable conduit 721; 20% movement of a compensation volume displacement element 715 results in a displacement of 2 units of fluid volume in the elastically deformable conduit 721; and so on. Without compensation of flow using the volume displacement elements 715 of the claimed invention, input flow and output flow of the conduit 721 would be erratic (i.e., flow in a forward and reverse direction within a control cycle) and, thus, non-linear as discussed above in the background.

Figure 9:
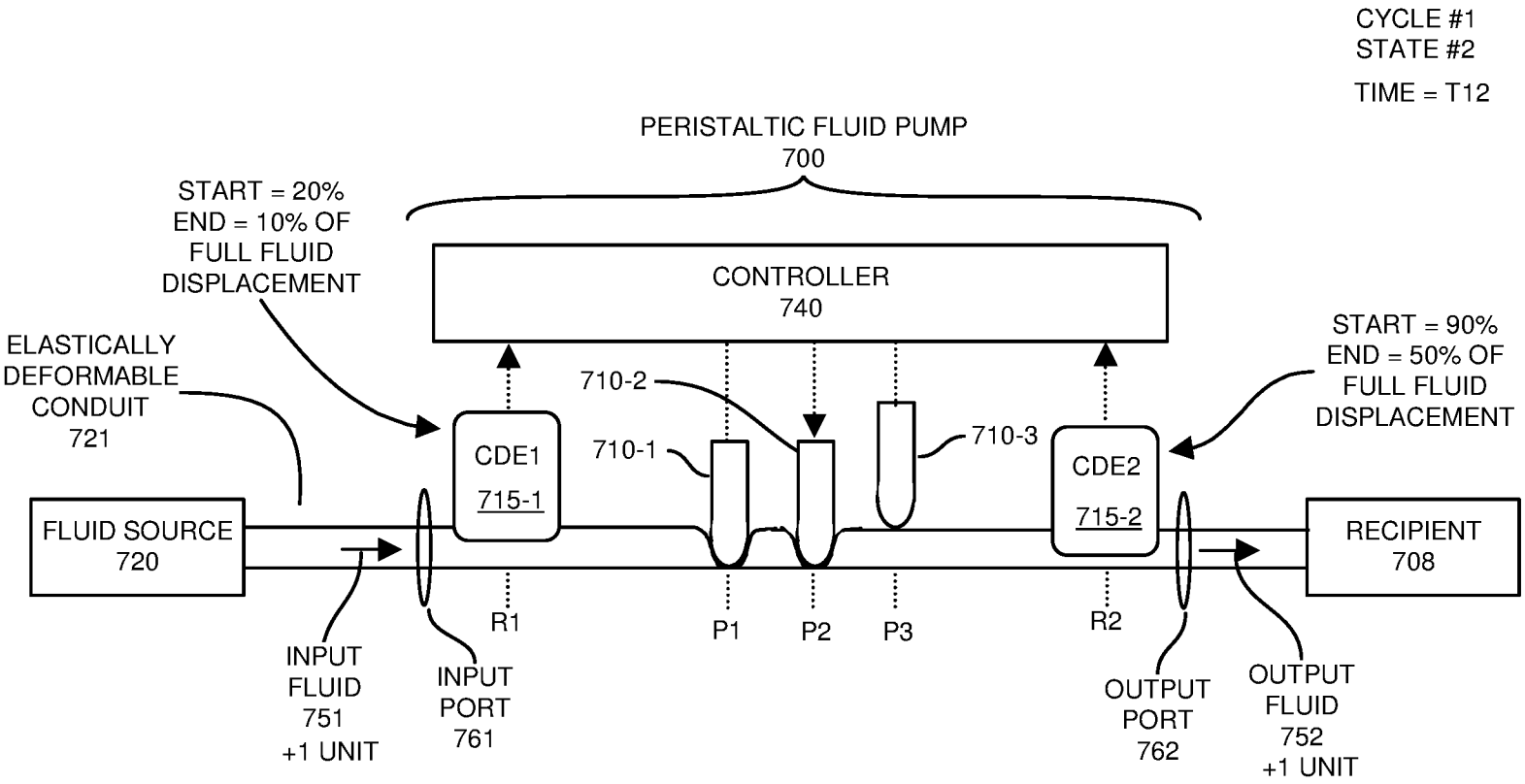
FIG. 9 is an example diagram illustrating a second state of operating a fluid pump according to embodiments herein.

FIG. 9 is an example diagram illustrating a second state of operating a fluid pump according to embodiments herein.

Between time T11 and time T12 of a respective control cycle, the controller 740 moves volume displacement element 710-2 to occlude the elastically deformable conduit 721 at location P2. Downward movement of the volume displacement element 710-2 at location P2 causes a linear displacement of 5 units of the fluid. Since the controller 740 also moves the compensation volume displacement element 715-2 up 40% of its full displacement range from 90% to the 50% closed position, 4 units of fluid is displaced. In such an instance, the resulting flow of fluid downstream from output port 762 of the elastically deformable conduit 721 is one unit of fluid volume downstream (e.g., 5 units of fluid volume flows downstream from moving volume displacement element 710-2 less 4 units of fluid volume flows upstream based on moving compensation volume displacement element 715-2). Thus, between time T11 and time T12, the controller 740 delivers a total of 1 unit of output fluid 752 at a constant flow rate to the recipient 708 through output port 762 of the elastically deformable conduit 721.

Additionally, between time T11 and time T12, the controller 740 moves the compensation volume displacement element 715-1 from 20% to 10% closed, causing a displacement of 1 unit of fluid downstream from fluid source 720. In such an instance, the resulting flow of fluid downstream from fluid source 720 through input port 761 is one unit of fluid volume. Thus, between time T11 and time T12, the controller 740 delivers 1 unit of input fluid 751 at a constant flow rate from fluid source 720 through the input port 761 to the elastically deformable conduit 721 of peristaltic fluid pump 700. The flow rate of the input fluid 751 between time T11 and time T12 is equivalent to the flow rate of the output fluid 752 between time T11 and time T12.

Figure 10:
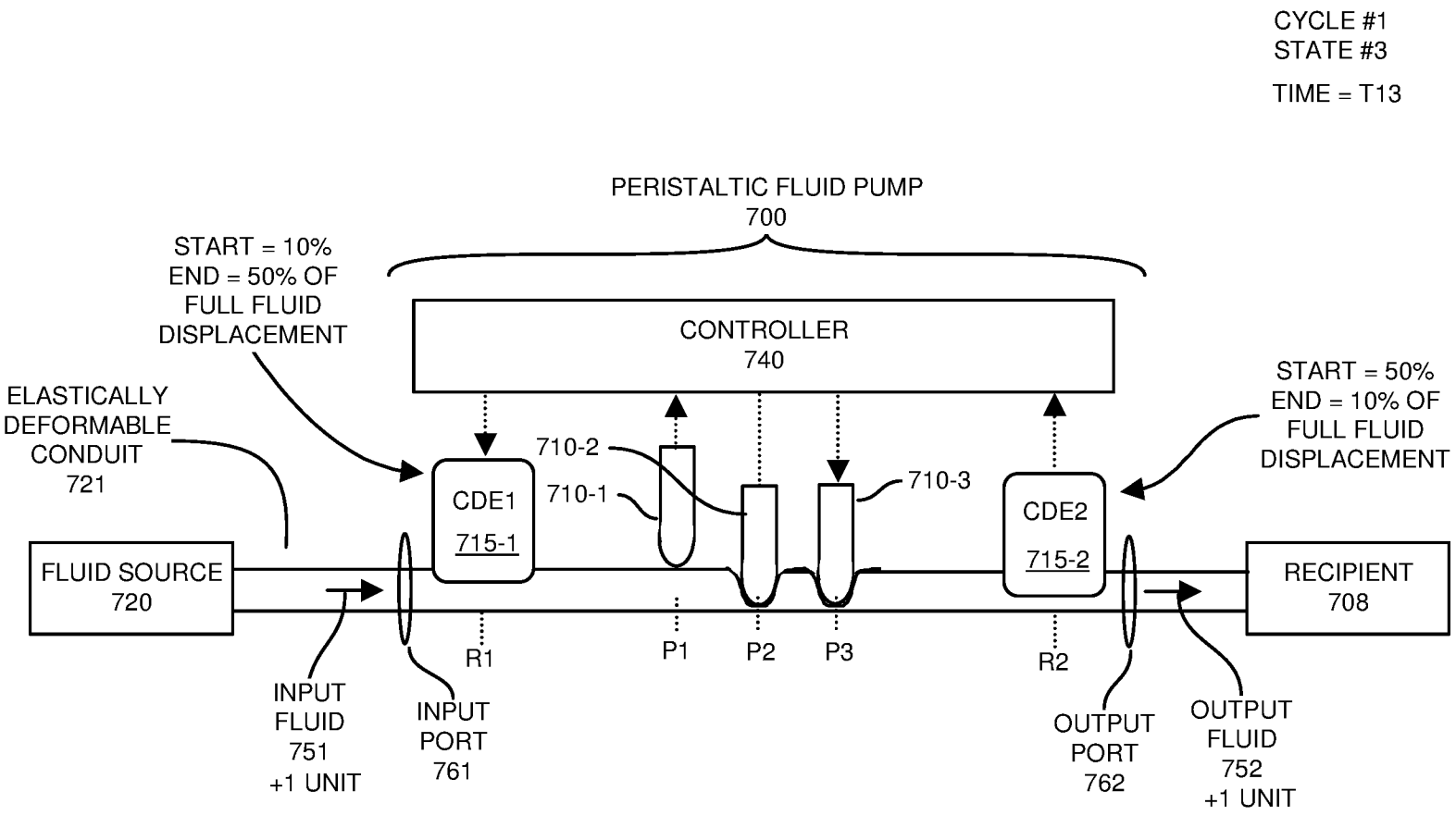
FIG. 10 is an example diagram illustrating a third state of operating a fluid pump according to embodiments herein.

FIG. 10 is an example diagram illustrating a third state of operating a fluid pump according to embodiments herein.

Between time T12 and time T13 of a respective control cycle, the controller 740 moves volume displacement element 710-3 to occlude the elastically deformable conduit 721 at location P3. Downward movement of the volume displacement element 710-3 at location P3 causes a displacement of 5 units of the fluid at a constant flow rate to the recipient 108. Since the controller 740 also moves the compensation volume displacement element 715-2 up 40% of its full displacement range from 50% to the 10% closed position, 4 units of fluid is displaced. In such an instance, the resulting flow of fluid downstream from output port 762 of the elastically deformable conduit 721 is one unit of fluid volume (e.g., 5 units of fluid volume flows downstream from moving volume displacement element 710-3 less 4 units of fluid volume flows upstream based on moving compensation volume displacement element 715-2). Thus, between time T12 and time T13, the controller 740 delivers a total of 1 unit of output fluid 752 at a constant flow rate to the recipient 708 through the output port 762 of elastically deformable conduit 721.

Additionally, between time T12 and time T13, the controller 740 moves volume displacement element 710-1 up so that it no longer occludes the elastically deformable conduit 721 at location P1. Upward movement of the volume displacement element 710-1 at location P1 (from full closed to full open) causes a linear (over time) displacement of 5 units of the fluid. The controller 740 also moves the compensation volume displacement element 715-1 from 10% to 50% closed, causing a displacement of 4 units of fluid. In such an instance, the resulting flow of fluid downstream from fluid source 720 through input port 761 is one unit of fluid volume (e.g., 5 units of fluid volume flows downstream from moving volume of displacement element 710-1 less 4 units of fluid volume flows upstream from moving of compensation volume displacement element 715-1). Thus, between time T12 and time T13, the controller 740 delivers 1 unit of input fluid 751 at a constant flow rate from fluid source 720 through the input port 761 to the elastically deformable conduit 721 of peristaltic fluid pump 700.

The flow rate of the input fluid 751 between time T12 and time T13 is equivalent to the flow rate of the output fluid 752 between time T12 and time T13.

Figure 11:
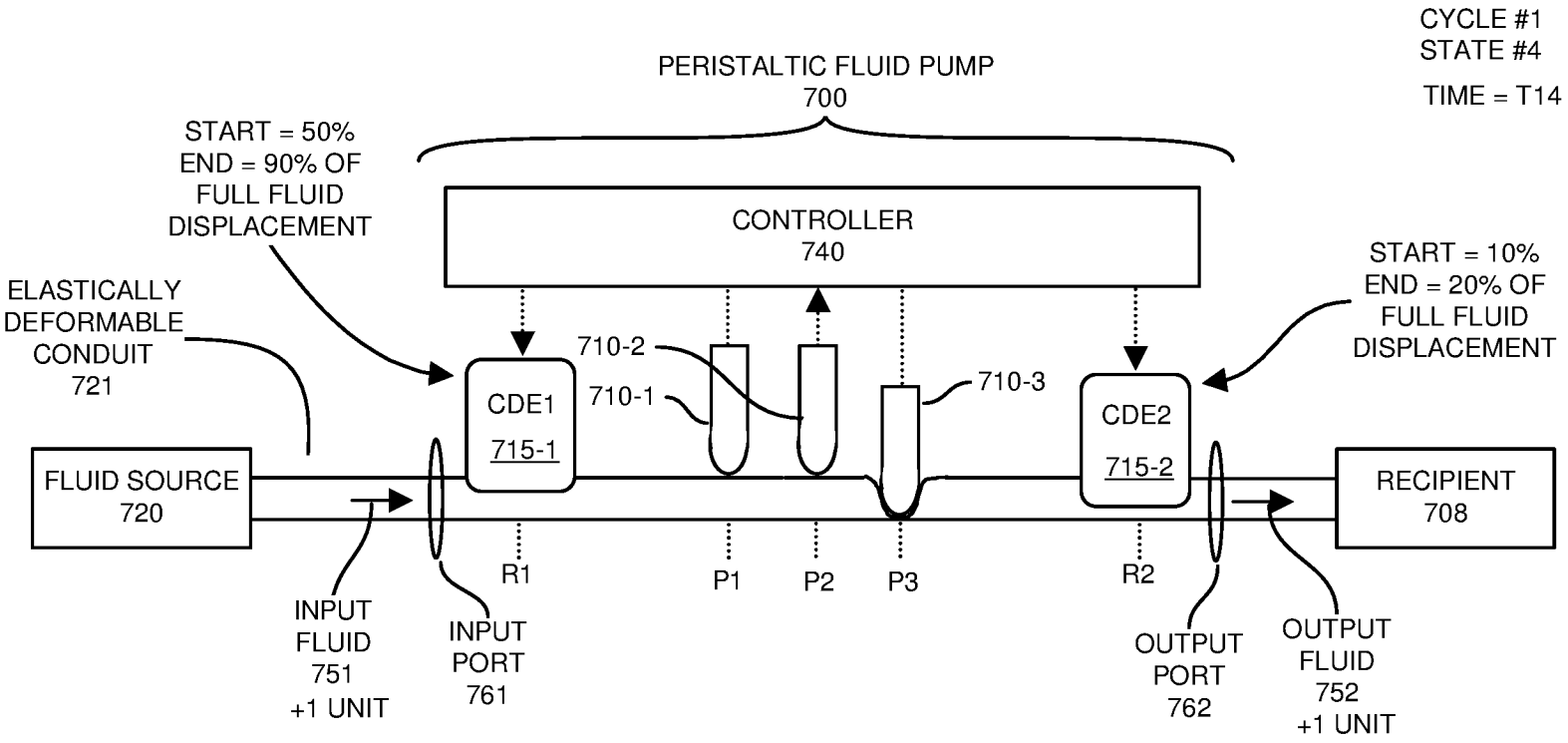
FIG. 11 is an example diagram illustrating a fourth state of operating a fluid pump according to embodiments herein.

FIG. 11 is an example diagram illustrating a fourth state of operating a fluid pump according to embodiments herein.

Between time T13 and time T14 of a respective control cycle, the controller 740 moves the compensation volume displacement element 715-2 down 10% of its full displacement range from 10% to the 20% closed position, resulting in 1 unit of fluid displacement. Thus, between time T13 and time T14, the controller 740 delivers a total of 1 unit of output fluid 752 through the elastically deformable conduit 721 at a constant flow rate through output port 762 to the recipient 708.

Additionally, between time T13 and time T14, the controller 740 moves volume displacement element 710-2 so that it no longer occludes the elastically deformable conduit 721 at location P2. Upward movement of the volume displacement element 710-2 at location P2 (from full closed to full open) causes a linear (over time) displacement of 5 units of the fluid. The controller 740 also moves the compensation volume displacement element 715-1 from 50% to 90% closed, causing a displacement of 4 units of fluid. In such an instance, the resulting flow of input fluid 751 downstream from fluid source 720 through input port 761 is one unit of fluid volume (e.g., 5 units of fluid volume flows downstream from moving volume of displacement element 710-1 less 4 units of fluid volume flows upstream from moving of compensation volume displacement element 715-1). Thus, between time T13 and time T14, the controller 740 delivers 1 unit of input fluid 751 at a constant flow rate from fluid source 720 through the input port 761 to the elastically deformable conduit 721 of peristaltic fluid pump 700.

The flow rate of the input fluid 751 between time T13 and time T14 is equivalent to the flow rate of the output fluid 752 between time T13 and time T14.

Figure 12:
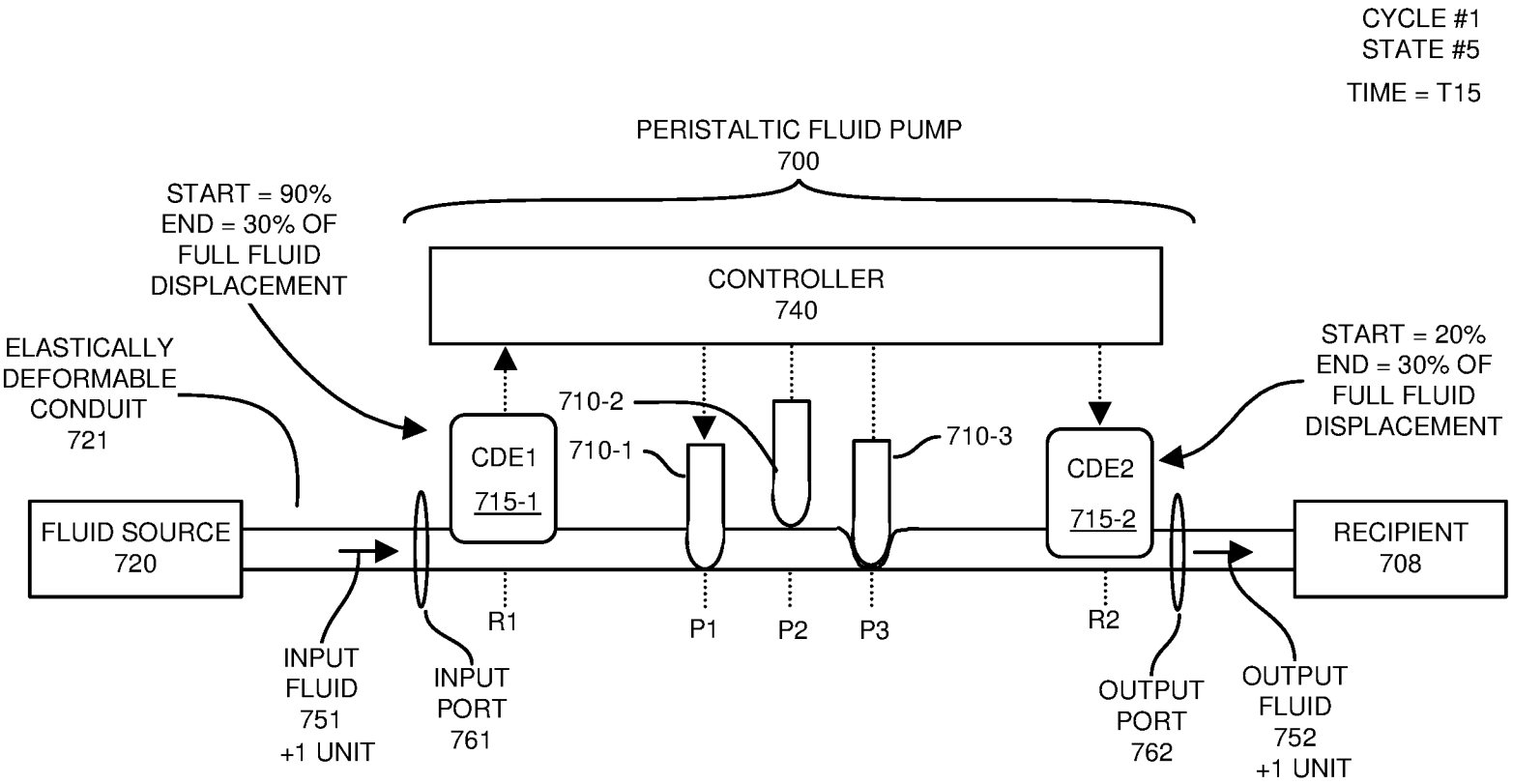
FIG. 12 is an example diagram illustrating a fifth state of operating a fluid pump according to embodiments herein.

FIG. 12 is an example diagram illustrating a fifth state of operating a fluid pump according to embodiments herein.

Between time T14 and time T15 of a respective control cycle, the controller 740 moves the compensation volume displacement element 715-2 down 10% of its full displacement range from 20% to the 30% closed position, 1 unit of fluid is displaced downstream through output port 762 to recipient 708. Thus, between time T14 and time T15, the controller 740 delivers a total of 1 unit of output fluid 752 at a constant flow rate to the recipient 708 through output port 762 of the elastically deformable conduit 721.

Additionally, between time T14 and time T15, the controller 740 moves volume displacement element 710-1 (F1) down to occlude the elastically deformable conduit 721 at location P1. Downward movement of the volume displacement element 710-1 at location P1 (from full open to full closed) causes displacement of 5 units of the fluid. The controller 740 also moves the compensation volume displacement element 715-1 from 90% to 30% closed, causing a displacement of 6 units of fluid. In such an instance, the controller 740 delivers 1 unit of input fluid 751 at a constant flow rate from fluid source 720 through the input port 761 to the elastically deformable conduit 721 of peristaltic fluid pump 700 between time T14 and time T15.

The flow rate of the input fluid 751 between time T14 and time T15 is equivalent to the flow rate of the output fluid 752 between time T14 and time T15.

Figure 13:
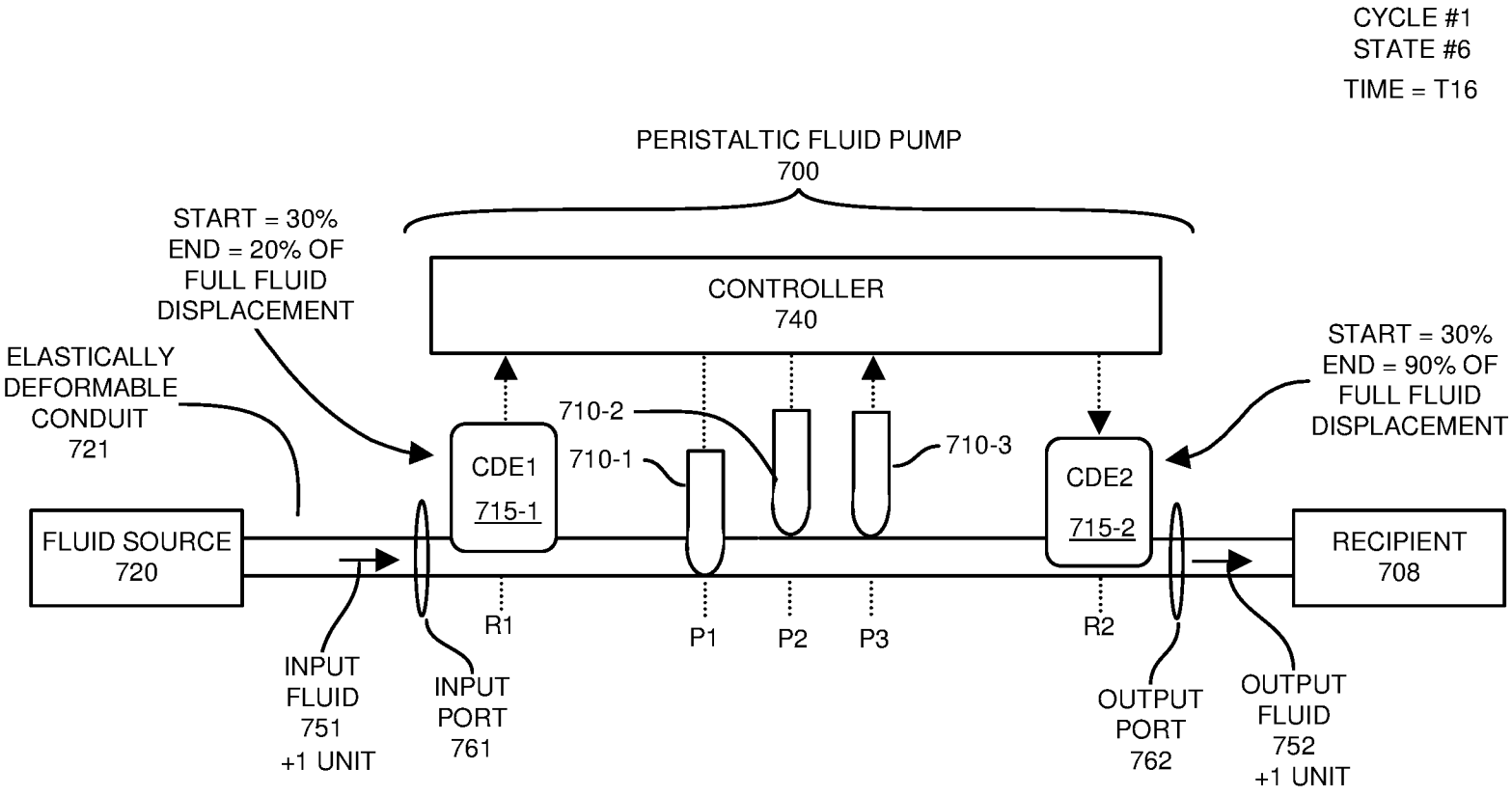
FIG. 13 is an example diagram illustrating a sixth state of operating a fluid pump according to embodiments herein.
Figure 14:
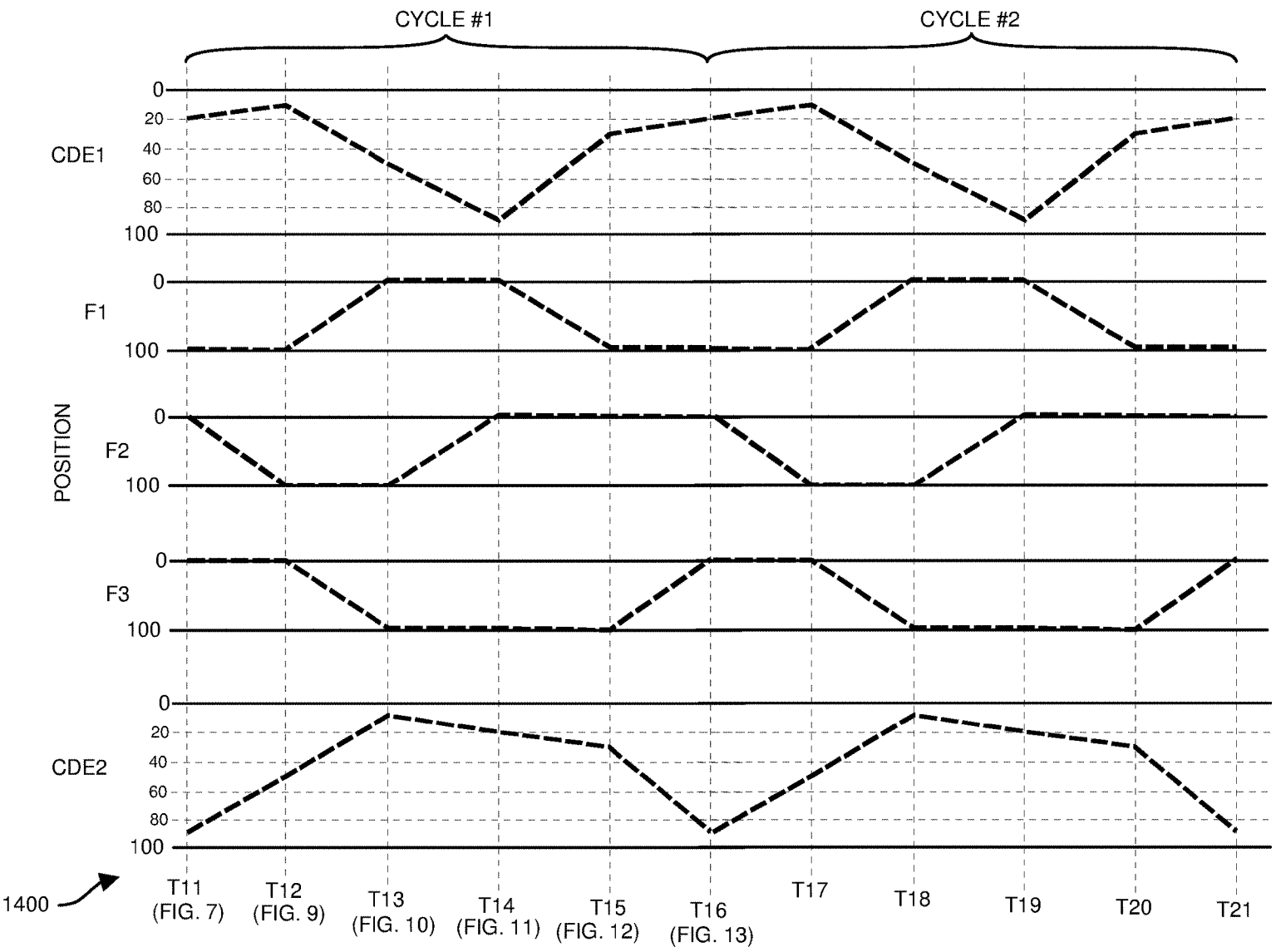
FIG. 14 is an example diagram illustrating a timing diagram of multiple control cycles of controlling volume displacement elements according to embodiments herein.

FIG. 13 is an example diagram illustrating a sixth state of operating a fluid pump according to embodiments herein.

Between time T15 and time T16 of a respective control cycle, the controller 740 moves volume displacement element 710-3 (F3) to discontinue occluding the elastically deformable conduit 721 at location P3. Upward movement of the volume displacement element 710-3 at location P3 causes a displacement of 5 units of the fluid. Since the controller 740 also moves the compensation volume displacement element 715-2 down 60% of its full displacement range from 30% to the 90% closed position, 6 units of fluid is displaced. In such an instance, the resulting flow of fluid downstream from output port 762 of the elastically deformable conduit 721 is one unit of fluid volume (e.g., 6 units of fluid volume flows downstream from moving volume displacement element 715-2 less 5 units of fluid volume flows upstream based on moving volume displacement element 710-3). Thus, between time T15 and time T16, the controller 740 delivers a total of 1 unit of output fluid 752 at a constant flow rate to the recipient 708 through output port 762 of elastically deformable conduit 721.

Additionally, between time T15 and time T16, the controller 740 moves the compensation volume displacement element 715-1 up 10% from 30% to 20% closed, causing a displacement of 1 unit of fluid. In such an instance, the resulting flow of fluid downstream from fluid source 720 through input port 761 is one unit of fluid volume. Thus, between time T15 and time T16, the controller 740 delivers 1 unit of input fluid 751 at a constant flow rate from fluid source 720 through the input port 761 to the elastically deformable conduit 721 of peristaltic fluid pump 700. The flow rate of the input fluid 751 between time T15 and time T16 is equivalent to the flow rate of the output fluid 752 between time T15 and time T16.

Accordingly, embodiments herein include a controller 740 operable to control movement of the multiple volume displacement elements 710 and compensation volume displacement elements 715, which results in: i) constant uni-directional flow of the input fluid 751 from fluid source 720 to the elastically deformable conduit 721, and ii) constant uni-directional flow of the output fluid 752 from elastically deformable conduit 721 to the recipient 108.

Note that the control cycle (FIGS. 7 and 9-13) of controlling the multiple volume displacement elements of the respective peristaltic pump illustrate a more desirable (substantially linear) volumetric flow of fluid from the fluid source 120 through the elastically deformable conduit 721 to the recipient 108. For example, the controller 740 controls flow of fluid to be one unit of volume of fluid per displacement operation (which includes 5 displacement operations per cycle between T11 and T16). The substantially constant (such as +/−5% of point) flow of input fluid 751 through input port 761 and substantially constant (such as +/−5% of point) flow of output fluid 752 through output port 762 allows flow rate measurement of an input fluid 751 to the peristaltic fluid pump 700 to be used to adjust and control flow out of the pump 150 to the recipient 708. An example of such use is discussed in related U.S. patent application Ser. No. 15/468,558 entitled "FLUID FLOW CONTROL AND DELIVERY VIA MULTIPLE FLUID PUMPS," filed on Mar. 24, 2017, the entire teachings of which are incorporated herein by this reference.

FIG. 14 is an example timing diagram illustrating multiple control cycles of controlling volume displacement elements according to embodiments herein. As shown, timing diagram 1400 illustrates continuous linear flow of fluid (i.e., fluid flows downstream to the recipient 108 at a constant flow rate) over multiple cycles of controlling movement of the volume displacement elements 710 and compensation volume displacement elements 715.

Assume that the fluid source 720 contains 15 mL (milliliter) of drug X to be delivered to respective recipient 708 (such as a patient) as specified by a corresponding drug order (prescription). Assume further that the drug order indicates to deliver the drug X (liquid) at a constant rate of 1 mL/minute.

In such an instance, the operator of the peristaltic fluid pump 700 starts delivery at time T11. The controller 740 programmed with the drug order controls volume displacement elements 710 and 715 to deliver the drug X at a constant rate of 1 mL/minute. For example, between time T11 and time T12 (duration of 1 minute): the fluid pump 700 receives a total of 1 mL of drug X through the input port 761; the fluid pump 700 outputs a total of 1 mL of drug X through the output port 762 to the recipient 708.

Between time T12 and time T13 (duration of 1 minute): the fluid pump 700 receives a total of 1 mL of drug X through the input port 761; the fluid pump 700 outputs a total of 1 mL of drug X through the output port 762 to the recipient 708.

Between time T13 and time T14 (duration of 1 minute): the fluid pump 700 receives a total of 1 mL of drug X through the input port 761; the fluid pump 700 outputs a total of 1 mL of drug X through the output port 762 to the recipient 708.

Between time T14 and time T15 (duration of 1 minute): the fluid pump 700 receives a total of 1 mL of drug X through the input port 761; the fluid pump 700 outputs a total of 1 mL of drug X through the output port 762 to the recipient 708.

Between time T15 and time T16 (duration of 1 minute): the fluid pump 700 receives a total of 1 mL of drug X through the input port 761; the fluid pump 700 outputs a total of 1 mL of drug X through the output port 762 to the recipient 708.

Thus, in the cycle #1, the fluid pump 700 delivers 5 mL of drug X to the recipient 708 at a constant flow rate of 1 mL/minute. Via cycles, the controller 140 delivers the full 15 mL does to the recipient 708 over a 15-minute time interval.

Figure 15:
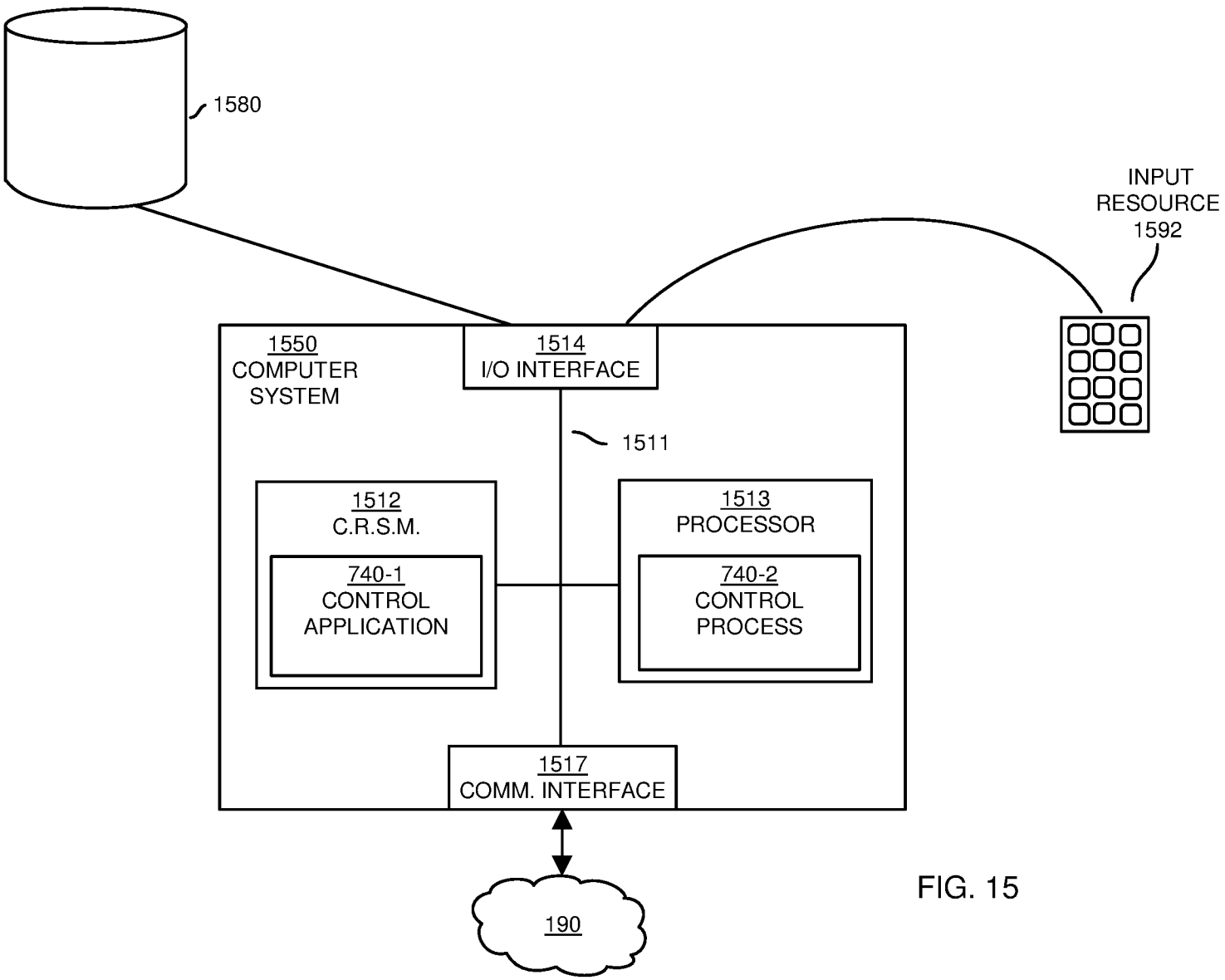
FIG. 15 is an example diagram illustrating a computer system in which to execute any of the functionality according to embodiments herein.

FIG. 15 is an example block diagram of a computer system for implementing any of the operations as discussed herein according to embodiments herein.

Any of the resources (such as controller 740) as discussed herein can be configured to include computer processor hardware and executable instructions to carry out any of the operations as discussed herein.

As shown, computer system 1550 of the present example includes an interconnect 1511 coupling computer readable storage media 1512 such as a non-transitory type of media (such as a hardware storage medium) in which digital information can be stored and retrieved, a processor 1513 (computer processor hardware), I/O interface 1514, and a communications interface 1517. I/O interface 1514 supports connectivity to repository 1580 and input resource 1592.

Computer readable storage medium 1512 (hardware to store instructions) can be any hardware storage device such as memory, optical storage, hard drive, floppy disk, etc. In one embodiment, the computer readable storage medium 1512 stores instructions and/or data.

As shown, computer readable storage media 1512 can be encoded with connection management application 740-1 (e.g., including instructions) to carry out any of the operations as discussed herein.

During operation of one embodiment, processor 1513 accesses computer readable storage media 1512 via the use of interconnect 1511 in order to launch, run, execute, interpret or otherwise perform the instructions in connection management application 740-1 stored on computer readable storage medium 1512. Execution of the control application 740-1 produces control process 740-2 to carry out any of the operations and/or processes as discussed herein.

Those skilled in the art will understand that the computer system 1550 can include other processes and/or software and hardware components, such as an operating system that controls allocation and use of hardware resources to execute control application 740-1.

In accordance with different embodiments, note that computer system may be included in any of various types of devices, including, but not limited to, a mobile computer, a personal computer system, a wireless device, base station, phone device, desktop computer, laptop, notebook, netbook computer, mainframe computer system, handheld computer, workstation, network computer, application server, storage device, a consumer electronics device such as a camera, camcorder, set top box, mobile device, video game console, handheld video game device, a peripheral device such as a switch, modem, router, set-top box, content management device, handheld remote control device, any type of computing or electronic device, etc. The computer system 1550 may reside at any location or can be included in any suitable resource in any network environment to implement functionality as discussed herein.

Functionality supported by the different resources will now be discussed via flowcharts in FIG. 16. Note that the steps in the flowcharts below can be executed in any suitable order.

Figure 16:
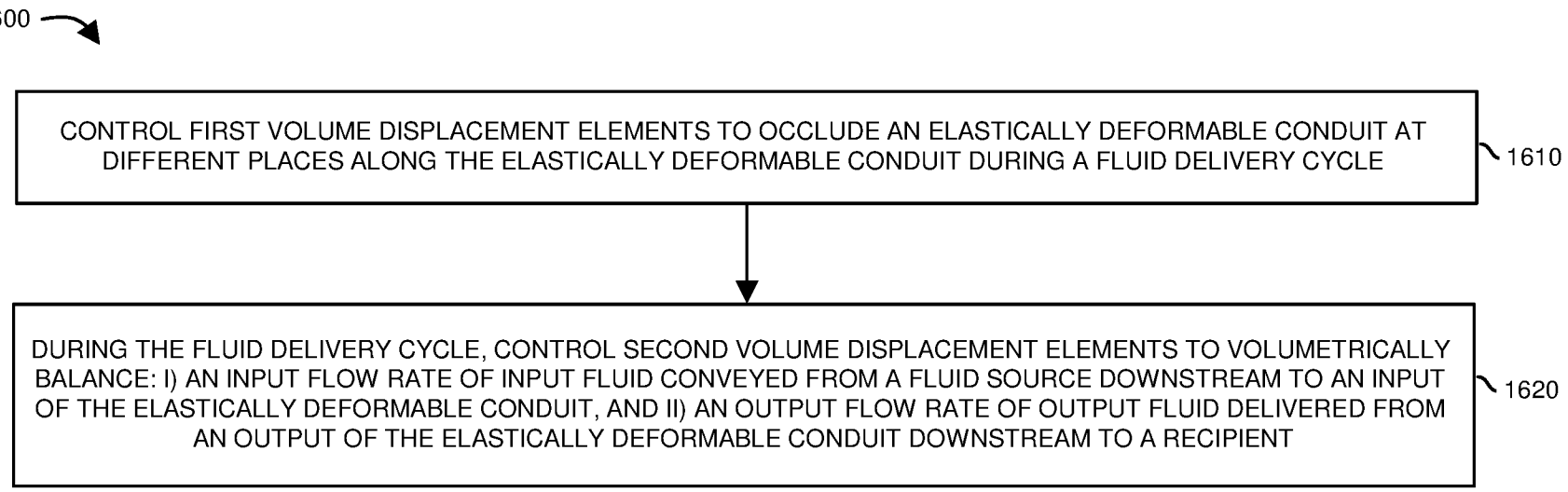
FIG. 16 is an example diagram illustrating a method according to embodiments herein.

FIG. 16 is a flowchart 1600 illustrating an example method according to embodiments. Note that there will be some overlap with respect to concepts as discussed above.

In processing operation 1610, the controller 740 controls (first) volume displacement elements 710 to occlude an elastically deformable conduit 721 at different places along its length during a fluid delivery cycle.

In processing operation 1620, during the fluid delivery cycle, the controller 740 controls (second) compensation volume displacement elements 715 (such as CDE1 and CDE2) to volumetrically balance: i) an input flow rate of input fluid 751 conveyed from a fluid source 720 downstream to an input (a input port 761) of the elastically deformable conduit 721, and ii) an output flow rate of output fluid 762 delivered from an output (such as output port 762) of the elastically deformable conduit 721 downstream to a recipient 708.

Note again that techniques herein are well suited for controlling a flow of fluid from a fluid source to a recipient. However, it should be noted that embodiments herein are not limited to use in such applications and that the techniques discussed herein are well suited for other applications as well.

Based on the description set forth herein, numerous specific details have been set forth to provide a thorough understanding of claimed subject matter. However, it will be understood by those skilled in the art that claimed subject matter may be practiced without these specific details. In other instances, methods, apparatuses, systems, etc., that would be known by one of ordinary skill have not been described in detail so as not to obscure claimed subject matter. Some portions of the detailed description have been presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm as described herein, and generally, is considered to be a self-consistent sequence of operations or similar processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has been convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like refer to actions or processes of a computing platform, such as a computer or a similar electronic computing device, that manipulates or transforms data represented as physical electronic or magnetic quantities within memories, registers, or other information storage devices, transmission devices, or display devices of the computing platform.

While this invention has been particularly shown and described with references to preferred embodiments thereof, it will be understood by those skilled in the art that various changes in form and details may be made therein without departing from the spirit and scope of the present application as defined by the appended claims. Such variations are intended to be covered by the scope of this present application. As such, the foregoing description of embodiments of the present application is not intended to be limiting. Rather, any limitations to the invention are presented in the following claims.

We claim:

1. A system comprising:

an elastically deformable conduit;

multiple volume displacement elements to contact the elastically deformable conduit and displace fluid in the elastically deformable conduit, the multiple volume displacement elements disposed between an input port and an output port of the elastically deformable conduit; and a controller to control movement of the multiple volume displacement elements, the controller volumetrically balancing: i) an input flow rate of input fluid conveyed from a fluid source into the input port of the elastically deformable conduit, and ii) an output flow rate of output fluid delivered from the output port of the elastically deformable conduit to a recipient; and wherein the controlled movement equalizes the output flow rate and the input flow rate;

wherein the multiple volume displacement elements controlled by the controller include: first displacement elements and second displacement elements disposed between the input port and the output port;

wherein the second displacement elements include a first compensation displacement element and a second compensation displacement element;

wherein the first displacement elements include a first volume displacement element, a second volume displacement element, and a third volume displacement element;

wherein the second volume displacement element is disposed between the first volume displacement element and the third volume displacement element;

wherein the first displacement elements are disposed between the first compensation displacement element and the second compensation displacement element;

wherein the first compensation displacement element is disposed between the input port and the first volume displacement element;

wherein the second compensation displacement element is disposed between the third volume displacement element and the output port;

wherein the first displacement elements are controlled by the controller to occlude fluid flow through the elastically deformable conduit at different times during a delivery cycle to deliver the output fluid downstream from the output port of the elastically deformable conduit to the recipient; and wherein the second displacement elements including the first compensation displacement element and the second compensation displacement element are controlled by the controller at multiple different non-blocking positional settings to provide fluid flow compensation for the first displacement elements.

2. The system as in claim 1, wherein the input flow rate and the output flow rate are substantially constant and greater than zero.

3. The system as in claim 1, wherein the movement of the multiple volume displacement elements results in: i) constant uni-directional flow of the input fluid into the input port of the elastically deformable conduit, and ii) constant uni-directional flow of the output fluid from the output port of the elastically deformable conduit to the recipient.

4. The system as in claim 1, wherein controlled movement of the multiple volume displacement elements prevents a backflow of the input fluid received at the input port of the elastically deformable fluid toward the fluid source.

5. The system as in claim 1, wherein the controller is operable to:

while the second volume displacement element occludes fluid flow through the elastically deformable conduit, control movement of the first volume displacement element to draw the input fluid downstream from the fluid source into the input port of the elastically deformable conduit.

6. The system as in claim 1, wherein the controller is operable to, while the second volume displacement element occludes fluid flow through the elastically deformable conduit, simultaneously control movement of the first volume displacement element and the third volume displacement element in opposite displacement directions to convey the output fluid downstream from the output port of the elastically deformable conduit to the recipient at a desired flow rate.

7. The system as in claim 1, wherein the controller is operable to, while the first volume displacement element occludes fluid flow through the elastically deformable conduit, control movement of the second volume displacement element and the third volume displacement element in opposite displacement directions to convey the output fluid downstream from the output port of the elastically deformable conduit to the recipient at a desired flow rate.

8. The system as in claim 1, wherein the controller is operable to:

while the second volume displacement element occludes fluid flow through the elastically deformable conduit: i) control movement of the third volume displacement element to convey the output fluid downstream from the output port of the elastically deformable conduit to the recipient, and ii) control movement of the first volume displacement element to draw the input fluid downstream from the fluid source into the input port of the elastically deformable conduit.

9. The system as in claim 1, wherein the multiple volume displacement elements:

are controlled by the controller to occlude fluid flow through the elastically deformable conduit at different times during a delivery cycle to deliver the output fluid downstream from the output port of the elastically deformable conduit to the recipient.

10. The system as in claim 1, wherein the fluid source is a first chamber of a diaphragm pump, the controller operable to measure a volume of a second chamber of the diaphragm pump to determine a flow rate of the input fluid delivered to the input port of the elastically deformable conduit.

11. The system as in claim 1, wherein the input flow rate and the output flow rate are continuously equal during an entirety of each of multiple repetitive control cycles of controlling the multiple volume displacement elements.

12. The system as in claim 11, wherein the input flow rate and the output flow rate are set to a fixed flow rate value during an entirety of each of the multiple repetitive control cycles of controlling the multiple volume displacement elements.

13. The system as in claim 12, wherein the controller controls each of the first volume displacement elements to prevent flow of fluid through the elastically deformable conduit at least once during each of the multiple repetitive control cycles; and wherein the controller prevents each of the second volume displacement elements from occluding flow of the fluid through the elastically deformable conduit during an entirety of each of the multiple repetitive control cycles.

14. The system as in claim 1, wherein movement of the multiple volume displacement elements ensures that the input flow rate and the output flow rate are equal and constant during an entirety of each of the multiple repetitive control cycles of controlling the multiple volume displacement elements.

15. The system as in claim 1, wherein the input flow rate and the output flow rate are fixed and equal during an entirety of each of multiple repetitive control cycles of controlling the multiple volume displacement elements.

16. The system as in claim 1, wherein the controller is operative to, during a segment of time of controlling the multiple volume displacement elements, move the first volume displacement element in a first direction and, prior to blocking flow of the fluid through the elastically deformable conduit, move the first volume displacement element in a second direction; and wherein the second direction is opposite the first direction.

17. The system as in claim 16, wherein movement of the first volume displacement element in the first direction and the second direction equalizes the output flow rate to the input flow rate.

18. The system as in claim 17, wherein the controller is operative to, during the segment of time of controlling the multiple volume displacement elements, move the second volume displacement element from a first position of not blocking the fluid from flowing through the elastically deformable conduit and a second position of blocking the fluid from flowing through the elastically deformable conduit.

19. The system as in claim 1, wherein the controller is operative to, during a segment of time of controlling the multiple volume displacement elements, move the first compensation displacement element in a first direction and then a second direction without blocking flow of fluid through the elastically deformable conduit, the second direction opposite the first direction; and wherein the controller is operative to, during the segment of time of controlling the multiple volume displacement elements, control the second volume displacement element and the third volume displacement element at different times to block the fluid from passing through the elastically deformable conduit.

20. The system as in claim 1, wherein movement of the first volume displacement element during a first portion of a control cycle is from full occluding of the fluid from flowing to full non-occluding the fluid from flowing; and wherein movement of the third volume displacement element during the first portion of the control cycle is from fully non-occluding the fluid from flowing to fully occluding the fluid from flowing.

21. The system as in claim 6, wherein the opposite displacement directions include a first displacement direction and a second displacement direction, the second displacement direction being opposite the first displacement direction.

22. The system as in claim 21, wherein a net result of controlling movement of the first volume displacement element and the second volume displacement element includes outputting the output fluid at the desired flow rate from the output port.

23. The system as in claim 1, wherein the first volume displacement element is operative to controllably occlude a first location of the elastically deformable conduit;

wherein the second volume displacement element is operative to controllably occlude a second location of the elastically deformable conduit;

wherein the third volume displacement element is operative to controllably occlude a third location of the elastically deformable conduit;

wherein the controller is operable to, while the second volume displacement element occludes fluid flow through the elastically deformable conduit at the first location, simultaneously control movement of: i) the first volume displacement element in a first direction towards decreased occlusion of the elastically deformable conduit at the first location, and ii) the third volume displacement element in a second direction towards increased occlusion of the elastically deformable conduit at the third location.

24. A method comprising: controlling first volume displacement elements to occlude an elastically deformable conduit at different places along the elastically deformable conduit during a fluid delivery cycle; during the fluid delivery cycle, controlling second volume displacement elements to volumetrically balance: i) an input flow rate of input fluid conveyed from a fluid source downstream into an input port of the elastically deformable conduit, and ii) an output flow rate of output fluid delivered from an output port of the elastically deformable conduit downstream to a recipient; wherein the output flow rate equals the input flow rate; wherein the first volume displacement elements include a first volume displacement element, a second volume displacement element, and a third volume displacement element; wherein the second volume displacement elements include a first compensation displacement element and a second compensation displacement element; wherein the second volume displacement element is disposed between the first volume displacement element and the third volume displacement element; wherein the first volume displacement elements are disposed between the first compensation displacement element and the second compensation displacement element; wherein the first compensation displacement element is disposed between the input port and the first volume displacement element; wherein the second compensation displacement element is disposed between the third volume displacement element and the output port, the method further comprising: controlling the first volume displacement elements to occlude fluid flow through the elastically deformable conduit at different times during a delivery cycle to deliver the output fluid downstream from the output port of the elastically deformable conduit to the recipient; and controlling the second volume displacement elements including the first compensation displacement element and the second compensation displacement element at multiple different non-blocking positional settings to provide fluid flow compensation for the first displacement elements.

25. The method as in claim 24 further comprising:

controlling the input flow rate and the output flow rate to be substantially constant and greater than zero.

26. The method as in claim 24 further comprising:

controlling movement of the first volume displacement elements and the second volume displacement elements to provide constant uni-directional flow of the output fluid to the recipient.

27. The method as in claim 24, wherein controlling the second volume displacement elements includes preventing a backflow of the input fluid received at the input of the elastically deformable fluid toward the fluid source.

28. The method as in claim 24, further comprising:

while the second volume displacement element occludes fluid flow through the elastically deformable conduit, controlling movement of the first volume displacement element to draw the input fluid downstream from the fluid source into the input of the elastically deformable conduit.

29. The method as in claim 24 further comprising:

while the second volume displacement element occludes fluid flow through the elastically deformable conduit, controlling movement of the first volume displacement element and the third volume displacement element in opposite directions to convey the output fluid downstream from the output of the elastically deformable conduit to the recipient at a desired flow rate.

30. The method as in claim 24 further comprising: while the second volume displacement element occludes fluid flow through the elastically deformable conduit: i) controlling movement of the third volume displacement element to convey the output fluid downstream from the output of the elastically deformable conduit to the recipient, and ii) controlling movement of the first volume displacement element to draw the input fluid downstream from the fluid source into the input of the elastically deformable conduit.

31. The method as in claim 24 further comprising:

controlling the second volume displacement elements to provide fluid flow compensation to volumetrically balance the input flow rate and the output flow rate.

32. The method as in claim 24, wherein the fluid source is a first chamber of a diaphragm pump, the method further comprising:

measuring a volume of a second chamber of the diaphragm pump to determine the output flow rate.

33. A system comprising:

an elastically deformable conduit;

multiple volume displacement elements to contact the elastically deformable conduit and displace fluid in the elastically deformable conduit, the multiple volume displacement elements disposed between an input port and an output port of the elastically deformable conduit; and a controller to control movement of the multiple volume displacement elements, the controller volumetrically balancing: i) an input flow rate of input fluid conveyed from a fluid source into the input port of the elastically deformable conduit, and ii) an output flow rate of output fluid delivered from the output port of the elastically deformable conduit to a recipient; and wherein the controlled movement equalizes the output flow rate and the input flow rate;

wherein the multiple volume displacement elements controlled by the controller include: first displacement elements and second displacement elements disposed between the input port and the output port;

wherein second displacement elements include a first compensation displacement element and a second compensation displacement element;

wherein the first displacement elements include a first volume displacement element, a second volume displacement element, and a third volume displacement element; and wherein the second volume displacement element is disposed between the first volume displacement element and the third volume displacement element;

wherein the first displacement elements are disposed between the first compensation displacement element and the second compensation displacement element;

wherein the first compensation displacement element is disposed between the input port and the first volume displacement element; and wherein the second compensation displacement element is disposed between the third volume displacement element and the output port; and wherein the controller is operative to:

for a first portion of a control cycle: i) control the second volume displacement element to completely block flow of the fluid; ii) control movement of the first compensation displacement element to compensate movement of the first volume displacement element; iii) control movement of the second compensation displacement element to compensate movement of the third volume displacement element such that the input flow rate of input fluid conveyed from a fluid source into the input port of the elastically deformable conduit is equal to the output flow rate of output fluid delivered from the output port of the elastically deformable conduit to a recipient.

* * * * *